US009719023B1

(12) United States Patent
Wu et al.

(10) Patent No.: US 9,719,023 B1
(45) Date of Patent: Aug. 1, 2017

(54) METHOD FOR RECOVERING SOLVENT FROM FROTH TREATMENT TAILINGS WITH IN-SITU STEAM GENERATION

(71) Applicant: SYNCRUDE CANADA LTD. in trust for the owners of the Syncrude Project as such owners exist now and in the future, Fort McMurray (CA)

(72) Inventors: Xin Alex Wu, Edmonton (CA); Sujit Bhattacharya, Edmonton (CA)

(73) Assignee: SYNCRUDE CANADA LTD. in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 0 days.

(21) Appl. No.: 15/071,081

(22) Filed: Mar. 15, 2016

(51) Int. Cl.
*C10G 1/04* (2006.01)

(52) U.S. Cl.
CPC ..... *C10G 1/047* (2013.01)

(58) Field of Classification Search
CPC ..... C10G 1/04
See application file for complete search history.

(56) References Cited

U.S. PATENT DOCUMENTS

| | | | | |
|---|---|---|---|---|
| 2,130,144 A * | 9/1938 | McClave | B03D 1/16 | 209/164 |
| 6,358,403 B1 * | 3/2002 | Brown | C10G 1/045 | 208/390 |
| 6,358,404 B1 * | 3/2002 | Brown | C10G 1/045 | 208/390 |
| 2011/0278202 A1 * | 11/2011 | Moran | B01D 17/0205 | 208/424 |

FOREIGN PATENT DOCUMENTS

| | | |
|---|---|---|
| CA | 1027501 | 3/1978 |
| CA | 2272035 | 11/2000 |
| CA | 2272045 | 11/2000 |
| CA | 2587166 | 9/2007 |
| CA | 2712725 | 11/2011 |
| CA | 2768852 | 11/2011 |
| CA | 2755637 | 4/2012 |
| CA | 2733342 | 9/2012 |

* cited by examiner

*Primary Examiner* — Randy Boyer
(74) *Attorney, Agent, or Firm* — Bennett Jones LLP

(57) ABSTRACT

A method for recovering hydrocarbon diluent from froth treatment tailings comprising bitumen, solids, hydrocarbon diluent and water is provided, comprising: introducing the froth treatment tailings into a vessel chamber and allowing the coarse solids to settle to the bottom of the vessel and form a solids layer having a portion of hydrocarbon diluent and a portion of water trapped therein; and heating the water in the solids layer to generate steam bubbles in-situ and strip the hydrocarbon diluent associated with the coarse solids to produce stripped tailings.

20 Claims, 1 Drawing Sheet

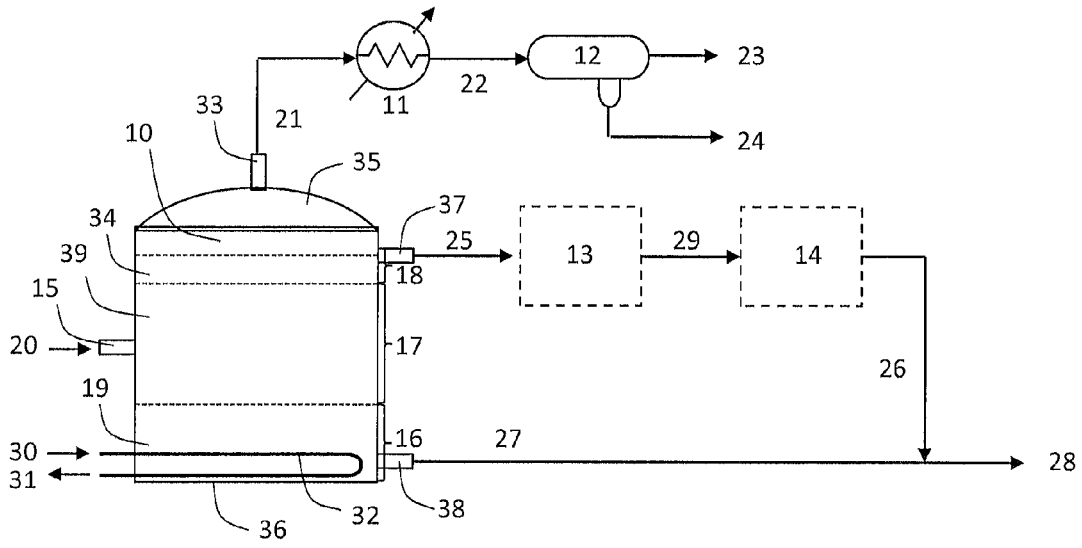
12
23
24
22
11
33
21
10
35
37
34
25
13
29
14
39
18
15
20
17
26
19
16
27
30
28
31
36
32
38

METHOD FOR RECOVERING SOLVENT FROM FROTH TREATMENT TAILINGS WITH IN-SITU STEAM GENERATION

FIELD OF THE INVENTION

The present invention relates generally to a method for recovering solvent from froth treatment tailings that are produced during bitumen froth treatment. More particularly, froth treatment tailings are allowed to settle in a solvent recovery vessel and the settled tailings are heated to generate steam in-situ.

BACKGROUND OF THE INVENTION

Oil sand, as known in the Fort McMurray region of Alberta, Canada, comprises water-wet sand grains having viscous bitumen flecks trapped between the grains. The oil sand lends itself to separating or dispersing the bitumen from the sand grains by slurrying the as-mined oil sand in water so that the bitumen flecks move into the aqueous phase.

The bitumen present in oil sand can be recovered using a hot/warm water process. In general, water extraction of bitumen involves slurrying oil sand with heated water, caustic (NaOH) and naturally entrained air. The slurry is then conditioned, for example, in tumblers or a hydrotransport pipeline, for a prescribed retention time to initiate a preliminary separation or dispersal of the bitumen and the solids and to induce air bubbles to contact and aerate the bitumen. The conditioned slurry is then subjected to flotation to further separate the bitumen from the sand.

Conditioned oil sand slurry may be further diluted with flood water and introduced into a large, open-topped, conical-bottomed, cylindrical vessel (termed a primary separation vessel or "PSV"). The diluted slurry is retained in the PSV under quiescent conditions for a prescribed retention period. During this period, the aerated bitumen rises and forms a froth layer, which overflows the top lip of the vessel and is conveyed away in a launder. The sand grains sink and are concentrated in the conical bottom. They leave the bottom of the vessel as a wet tailings stream. Middlings, a watery mixture containing solids and bitumen, extend between the froth and sand layers.

The wet tailings and middlings are withdrawn and may be combined for further processing in a secondary flotation process. This secondary flotation process is commonly carried out in a deep cone vessel wherein air is sparged into the vessel to assist with flotation. This vessel is referred to as the TOR vessel. It and the process conducted in it are disclosed in U.S. Pat. No. 4,545,892, incorporated herein by reference. The bitumen recovered by the TOR vessel is recycled to the PSV. The middlings from the deep cone vessel are further processed in air flotation cells to recover contained bitumen.

The froths produced by these units are generally combined and subjected to further processing. More particularly, it is conventional to dilute the bitumen froth with a light hydrocarbon diluent, such as naphtha or a paraffinic diluent, to improve the difference in specific gravity between the bitumen and water and reduce the bitumen viscosity, which aids in the separation of the water and solids from the bitumen. Separation of the bitumen from water and solids is commonly achieved by treating the froth in a sequence of scroll and disc centrifuges. However, there has been a recent trend towards using an inclined plate settling process for separating bitumen from the water and solids. Other processes for separating solids and water from diluted bitumen froth are known in the art and include stationary froth treatment (SFT) as described in U.S. Pat. No. 6,746,599, incorporated herein by reference.

The primarily water and solids fraction obtained after separation is commonly referred to as froth treatment tailings. These froth treatment tailings typically comprise approximately 2.0 wt. % hydrocarbon diluent, 3 wt. % bitumen, 20 wt. % solids and water as the remainder. It is desirable both economically and environmentally to recover the hydrocarbon diluent from the froth treatment tailings prior to disposal. However, the unique nature of the diluent-containing tailings makes diluent removal a challenge to the industry. In particular, it is believed that some of the diluent is intimately associated with the solids, making diluent removal from the solids more difficult.

Canadian Patent No. 1,027,501 discloses a process for treatment of centrifuge froth treatment tailings to recover hydrocarbon diluent (naphtha). The process comprises introducing the tailings into a vacuum flash vessel maintained at vacuum conditions (about 35 kPa) in order to flash the naphtha present in the tailings. The vessel is also equipped with a plurality of shed decks so that any residual naphtha remaining in the tailings stream will be vaporized by the introduction of steam beneath these shed decks. In practice, however, this process results in only 60 to 65% recovery of the diluent, as the vacuum at the tailings feed inlet of the vessel may have resulted in the tailings bypassing the shed decks and pooling near the bottom of the vessel. In the alternative, or additionally, the reduction in pressure in the tower to below atmospheric resulted in steam condensation and reduced heat transfer to the slurry. Thus, the pooled tailings at the bottom of the vessel still contained a substantially large amount of diluent. Canadian Patent No. 2,272,035 partially addressed this issue by introducing the steam into the tailings pool for vaporizing the residual diluent pooling near the bottom of the vessel. However, the naphtha recovery vessel was operating at sub-atmospheric pressure (30-35 kPa), which caused operational issues.

Canadian Patent No. 2,272,045 discloses a method for recovery of hydrocarbon diluent from tailings produced in a bitumen froth treatment plant comprising introducing the tailings into a steam stripping vessel maintained at near atmospheric pressure (e.g. around 95 kPa) in an attempt to avoid the problem of the tailings bypassing the shed decks. Without a vacuum, vessel pressure increased to atmospheric, or slightly above, and temperature increased to around 100° C. This resulted in increased naphtha recovery. The operating temperature of the vessel was preferably maintained at approximately 100° C.

However, while operating a steam stripping vessel for recovery of hydrocarbon diluent from tailings produced in a bitumen froth treatment plant at about 100° C. and at near atmospheric pressure significantly improved diluent recovery over previous operations at below atmospheric pressure (e.g., 35 kPa), there still was a significant amount of diluent remaining in the tailings pool. As stated in Canadian Patent No. 2,272,045, operating the vessel at near atmospheric pressure and at a steam to tailings ratio of approximately 9.0 wt. % increased the naphtha recovery to about 80%.

More recently, a steam stripping vessel with built-in stirrers was proposed (see Canadian Patent Nos. 2,712,725 and 2,768,852). Steam is introduced directly into the slurry pool through spargers. With the mechanical stirrers and spargers, the steam-slurry contact is improved. The residual naphtha contents in the stripped tailings are general 0.08-0.15 wt %, significantly lower than the naphtha recovery using the process of CA 2,272,035. However, addition of mechanical stirrers and spargers complicate the vessel design and introduce operational difficulties when processing abrasive materials such as the tailings.

In summary, the majority of the prior-art processes use live steam stripping in a vessel. In one case, the main steam-solids contact occurs at the shed decks, which is inherently limited due to short contact time and minimal agitation. Other processes rely on direct steam sparging, sometimes with additional mechanical agitation, to improve steam-solids contact. However, they are more challenging to operate in the presence of abrasive solids.

SUMMARY OF THE INVENTION

The current application is directed to a process for recovering a hydrocarbon diluent from froth treatment tailings. In particular, the present invention involves heating the froth treatment tailings in-situ to generate steam bubbles in-situ.

It was discovered that the majority of the coarse solids in the froth treatment tailings settle by gravity within minutes. A certain amount of water remains in the interstices of the settled coarse solids. It was surprisingly discovered that when the interstitial water trapped among the settled solids is sufficiently heated to boil, the in-situ generated steam bubbles rise through the settled solids layer, vigorously agitate the solids without the need of a mechanical stirrer.

It was further discovered that if heating occurs in the lower part of the solids layer, a temperature gradient forms with higher temperature on the lower part and lower temperature on the higher part of the solids layer. Thus, some of the in-situ generated steam bubbles implode after rising to the top surface of the solids layer due to cooling and condensation. The implosion sends out shock waves to vigorously agitate the tailings above the coarse solids layer without the need of a mechanical stirrer. These agitation actions combined with rising steam bubbles effectively strip solvent (e.g., hydrocarbon diluent such as naphtha) from the solids. In some instances, the resulting tailings may have a naphtha concentration as low as 0.02 wt %. It is important that conditions are such that heating and boiling occur below or within the settled solids layer, as it was discovered that boiling along the vessel wall above the solids layer is relatively ineffective in stripping solvent. Hence, the present invention removes solvent from froth treatment tailings with in-situ generated steam among solids for both agitation and stripping.

Thus, broadly stated, in one aspect of the present invention, a method for recovering hydrocarbon diluent from froth treatment tailings comprising bitumen, coarse solids, fine solids, hydrocarbon diluent and water is provided, comprising:

- introducing the froth treatment tailings into a vessel having an upper section, a middle section and a lower section;
- allowing the coarse solids to settle to the lower section of the vessel to form a solids layer having a portion of hydrocarbon diluent and a portion of water trapped therein; and
- heating the lower section of the vessel such that the water trapped in the solids layer generates steam bubbles in-situ to strip the hydrocarbon diluent associated with the coarse solids in the solids layer to produce stripped tailings and hydrocarbon diluent/water vapors.

In one embodiment, the method further comprises allowing a portion of the fine solids and bitumen to remain suspended in the middle section of the vessel and a portion of the fine solids and bitumen to rise to the top section of the vessel to form a froth layer. In one embodiment, the steam bubbles further strip the hydrocarbon diluent associated with the fine solids.

In one embodiment, the vessel is operated at or near atmospheric pressure in its overhead space. In one embodiment, the top section of the vessel is operated at or near a temperature of 100° C. As used herein, "at or near" means plus or minus 5%. In one embodiment, the froth treatment tailings are at a temperature of about 80° C. when added to the vessel chamber. It is understood that, because of hydrostatic pressure, the bottom of the vessel has a boiling point significantly higher than 100° C.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings:

FIG. 1 is a schematic of one embodiment of the present invention.

DETAILED DESCRIPTION OF PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practised without these specific details.

As used herein, "froth treatment tailings" means tailings which are produced during a bitumen froth treatment process that uses a hydrocarbon diluent such as a naphthenic diluent or a paraffinic diluent to dilute the bitumen froth prior to/during treatment. Generally, froth treatment tailings comprise water, solids, hydrocarbon diluent, and bitumen.

As used herein, "bitumen froth" refers to primary and/or secondary froths produced during extraction of bitumen from oil sand as recognized by the industry.

As used herein, "hydrocarbon diluent" means any substance containing one or more hydrocarbon compounds and/or substituted hydrocarbon compounds which is suitable for diluting and/or dissolving bitumen present in bitumen froth.

As used herein, a "naphthenic diluent" means a hydrocarbon diluent including naphtha produced from natural gas condensates, petroleum distillates, and the distillation of coal tar and peat and generally comprises a mixture of aromatic and non-aromatic compounds.

As used herein, a "paraffinic diluent" means a hydrocarbon diluent including a sufficient amount of one or more relatively short-chain aliphatic compounds such as $C_5$ to $C_8$ aliphatic compounds.

As used herein, "coarse solids" mean mineral solid particles with their largest dimension larger than 44 μm.

As used herein, "fine solids" mean mineral solid particles with their largest dimension smaller than 44 μm.

FIG. 1 shows one embodiment of the present invention. Froth treatment tailings 20 are added to a vessel 10 via inlet 15 which is located a distance from the bottom section 16 of the vessel 10. In the embodiment shown in FIG. 1, inlet 15 is located in the middle section 17 of the vessel 10. The coarse solids present in froth treatment tailings will settle to the bottom section 16 of the vessel 10 and form a solids layer 19. Generally, the froth treatment tailings 20 are fed at a rate allowing a residence time in the vessel 10 of about 20-70 minutes to allow solids settling to a desired degree.

In one embodiment, the vessel 10 is a cylindrical tank with an aspect ratio (tailings height/diameter) of about 1. In one embodiment, the vessel is essentially an empty tank. The solids layer 19 is heated by any means known in the art. In one embodiment, saturated steam 30 of any pressure heats the bottom of the unit 10 indirectly through large heat exchanging surfaces, which may be provided by a network of tubes/pipes 32. Condensed water 31 exits the heating tubes 32 and may be reused for steam generation. In another embodiment, the heating surface is provided by other means, for example, by electric heating coils. The heating section may extend upward from the bottom 36 of unit 10, but, generally, should not exceed 20% of the total tailings height (sum of layer thicknesses of 19, 34 and 39). In another embodiment, in addition to steam pipe or electric coil heating, the bottom surface 36 of the vessel 10 is heated with any external devices or means. In one embodiment, the feed stream 20 may be preheated to near boiling temperature of water, in addition to steam pipe or electric coil heating.

With heating, water among the settled solids (tailings layer 19) boils sending in-situ generated steam bubbles to the top 35 of the vessel 10, thus, travelling across its entire length. These steam bubbles create turbulence among solids and slurry, and strip hydrocarbon diluent from the tailings. The steam and hydrocarbon diluent vapors rise to the top 35 of the vessel 10 and exit via outlet 33 as steam and hydrocarbon diluent vapors stream 21. Stream 21 is then condensed in a heat exchanger 11 and condensed vapors 22 are separated in a separator 12 to produce recovered diluent 23 and water 24.

After coarse solids settling, the middle section 17 of the vessel 10 mainly contains a slurry layer 39 comprising water, suspended fine solids and bitumen drops. It was further observed that when steam bubbles rise through the tailings, they may also carry some bitumen, some residual solvent and fines. As a result, a froth layer 34 forms on top of the slurry layer 39 in the upper section 18 of the vessel 10. The froth layer 34 overflows and exits the vessel 10 via outlet 37 as froth stream 25. Generally, the mass flow rate of stream 25 is less than 20% of the mass flow rate of the feed stream 20.

The treated/stripped tailings are removed from the bottom section 16 of the vessel 10 via outlet 38 as underflow stream 27. In one embodiment, a waste heat recovery device such as a plate exchanger is used to recover heat from stream 27 and heat the feed stream 20. In one embodiment, froth stream 25 is combined with underflow stream 27. Alternatively, the froth stream 25 may be further treated to remove its bitumen content in a unit 13 and to remove its residual solvent content in a unit 14. In one embodiment, the unit 13 includes multiple units for solvent (e.g. naphtha diluent) addition/mixing and diluted bitumen separation from water-based slurry by gravity. The treated slurry 29 is then sent to the unit 14 for solvent recovery. In one embodiment, the unit 14 is settler/stripper unit similar to the vessel 10. The cleaned-up fines and water, stream 26, is then combined with the stream 27. Thus, stream 28 is the combination of either stream 25 and stream 27 or stream 26 and stream 27. The combined waste stream 28 is disposed in a tailings pond. In another embodiment, the froth stream 25 is sent back to the froth treatment plant for reprocessing. In this case stream 27 is the sole waste stream to be disposed.

In most instances, the in-situ generated steam bubbles agitate the solids layer on the bottom of the vessel 10 very vigorously. To further prevent caking in the heating section, the solids-rich slurry on the vessel bottom may be pumped around to keep solids somewhat mobile in the bottom layer. However, this pumping action should not be strong enough to homogenize the slurry in the vessel 10. Thus, besides the optional use of pumps, there are no moving parts in the vessel 10, yet adequate mixing of steam and solids/trapped hydrocarbon diluent still occurs through in-situ steam formation. Furthermore, steam bubbles are generated throughout the vessel's cross section, so no sparger is needed to distribute steam, as in the case of live steam injection into a slurry pool. Generally, the hydrocarbon diluent recovery with the present invention is above 90%. When froth treatment tailings are generated from froth treatment using naphtha, the naphtha recovery is generally above 95%. The residual naphtha content in the treated tailings is generally below 0.1 wt %.

Thus, as compared to prior art diluent recovery processes, the present invention may provide the additional benefit of forming a bitumen-rich froth stream, which may be further processed to recover bitumen. Further, when heating is provided by steam circulating through a piping system (as opposed to injecting steam directly into the vessel), it allows clean water to condense (in stream 31) and be reused after steam heating so that the demand for boiler feed water is minimized. This is especially valuable in winter months when river water import is near the regulated limit.

Example 1

In this example, a naphtha froth treatment tailings sample of about 520 g was placed in a cylindrical beaker of 8.3 cm diameter. The slurry height was about 9 cm. The beaker wall was insulated. The beaker was heated on a hot plate with various power settings with its top closed until boiling occurred. The sample was then boiled for a given period of time until it lost 10% of its original mass. Naphtha concentrations in the feed sample and the treated samples were analyzed and the results are shown in Table 1.

TABLE 1

| | Boiling Time (min) | | | | |
|---|---|---|---|---|---|
| Parameters | 0 | 44 | 51 | 73 | 80 |
| Naphtha Concentration* (wt %) | 1.419 | 0.056 | 0.018 | 0.018 | 0.041 |
| Naphtha Recovery (%) | 0 | 96.0 | 98.7 | 98.7 | 97.1 |

*The naphtha concentration was normalized by the original sample weight. The zero boiling time value refers to the feed property.

For comparison, the average naphtha concentration after live steam stripping in one commercial naphtha recovery unit (NRU) for the same sample was 0.24 wt % and the average naphtha recovery in the NRU was 83%.

Example 2

Another naphtha froth treatment tailings sample of about 520 g was placed in the aforementioned beaker. The sample was either heated directly on the hot plate or heated inside a larger beaker filled with silicon oil. A Teflon dish was placed below the sample beaker to block its bottom area from being heated directly by the hot plate, thus heating was exclusively from the beaker wall through the hot oil. The boiling time was about 45 min. The sample mass loss was about 10%. Naphtha concentrations in the feed sample and the treated samples were analyzed. The values shown in Table 2 are average ones of two measurements for each heating condition and four measurements for the feed.

TABLE 2

| Parameters | Feed | Bottom Heating | Wall Heating |
|---|---|---|---|
| Naphtha Concentration* (wt %) | 1.591 ± 0.37 | 0.138 ± 0.01 | 0.657 ± 0.02 |
| Naphtha Recovery (%) | 0 | 91.3 ± 0.6 | 58.7 ± 1.4 |

*The naphtha concentration was normalized by the original sample weight.

Note that this feed sample is not a typical one, likely generated under plant upset conditions. The normalized naphtha concentration after live steam stripping in one commercial NRU for this sample was 0.32 wt %. The average naphtha recovery in this NRU was 77%. The present method with bottom heating can still achieve a naphtha recovery above 90% on this difficult feed. Wall heating is ineffective since most of steam bubbles were generated above the settled solids layer and bypassed the naphtha containing solids.

Example 3

An equilibrium simulation was run using a commercial process simulator Aspen HYSYS 7.2. The froth treatment tailings feed contains 2.6 wt % bitumen, 1.7 wt % naphtha, 27.1 wt % solids and 68.5 wt % water. The feed has been preheated to 110° C. at 220 kPa. Other stream properties are shown in Table 3.

TABLE 3

| Stream #† | T (° C.) | Absolute P (kPa) | Mass flow (kg/s) | Hydrocarbon mass flow‡ (kg/s) | Water mass flow (kg/s) | Solids mass flow (kg/s) |
|---|---|---|---|---|---|---|
| 20 | 110 | 220 | 349.1 | 15.0 | 239.3 | 94.8 |
| 21 | 120 | 114 | 34.9 | 5.8 | 29.1 | 0 |
| 23 | 85 | 100 | 5.8 | 5.8 | 0 | 0 |
| 24 | 85 | 100 | 29.1 | 0 | 29.1 | 0 |
| 28 | 122 | 220 | 314.2 | 9.2 | 210.2 | 94.8 |
| 30 | 148 | 446 | 37.5 | 0 | 37.5 (gas) | 0 |
| 31 | 148 | 446 | 37.5 | 0 | 37.5 (liq) | 0 |
| Heating duty @ 30, 31 | | | 79.5 MW | | | |
| Cooling duty @ 11 | | | 71.1 MW | | | |
| Naphtha rec. @ 23 | | | 99.3% | | | |
| Steam/Feed | | | 0.107 | | | |

†Refer to FIG. 1 for stream #
‡Sum of bitumen and naphtha flow rates

The slurry density is 1080 kg/m$^3$. In a hypothetical tank of 10 m in diameter and 10 m in tailings height, the residence time is 40 min. Assuming the heat transfer coefficient, U, for the heating section is 1000 W/m$^2$K, the required heating area is 3118 m$^2$. The heating area can be reduced to 1254 m$^2$ if 1136 kPa steam is used instead of 446 kPa steam. This smaller area can be provided by a network of steam tubes at the bottom of the tank.

The naphtha recovery here is the thermodynamic limit for one-stage flashing. If steam/solids contact is ideal, this value can be closely approached in operation.

From the foregoing description, one skilled in the art can easily ascertain the essential characteristics of this invention and adapt it to various usages and conditions. Reference to an element in the singular, such as by use of the article "a" or "an" is not intended to mean "one and only one" unless specifically so stated, but rather "one or more". Nothing disclosed herein is intended to be dedicated to the public regardless of whether such disclosure is explicitly recited in the claims.

The invention claimed is:

1. A method for recovering hydrocarbon diluent from froth treatment tailings comprising bitumen, coarse solids, fine solids, hydrocarbon diluent and water, comprising:

introducing the froth treatment tailings into a vessel having an upper section, a middle section and a lower section;

allowing the coarse solids to settle to the lower section of the vessel to form a solids layer having a portion of hydrocarbon diluent and a portion of water trapped therein; and heating the lower section of the vessel using an indirect heat source such that the water trapped in the solids layer generates steam bubbles in-situ to strip the hydrocarbon diluent associated with the coarse solids and produce stripped tailings and hydrocarbon diluent/water vapors.

2. The method as claimed in claim 1, further comprising:

allowing a portion of the fine solids and bitumen to remain suspended in the middle section of the vessel and a portion of the fine solids and bitumen to rise to the top section of the vessel to form a froth layer.

3. The method as claimed in claim 2, wherein the steam bubbles further strip the hydrocarbon diluent associated with the fine solids.

4. The method of claim 1, wherein the upper section of the vessel is operated at a temperature at or near 100° C.

5. The method of claim 1, wherein the upper section of the vessel is operated at or near atmospheric pressure.

6. The method as claimed in claim 1, wherein the hydrocarbon diluent/water vapors rise through the vessel and are removed through an outlet in the upper section of the vessel.

7. The method as claimed in claim 6, wherein the removed hydrocarbon diluent/water vapors are condensed and the condensed vapors are separated in a separator to form a hydrocarbon diluent stream and a water stream.

8. The method as claimed in claim 1, wherein heating occurs below the level of 20% of the total tailings height in the vessel.

9. The method as claimed in claim 1, wherein the indirect heat source comprises a network of steam pipes situated in the lower section of the vessel.

10. The method of claim 1, wherein the indirect heat source comprises electric coils situated in the lower section of the vessel.

11. The method of claim 1, wherein the indirect heat source comprises an external heating device.

12. The method as claimed in claim 1, wherein the froth treatment tailings are pre-heated to a temperature of about 80° C. to about 110° C. prior to being introduced into the vessel.

13. The method of claim 12, wherein the froth treatment tailings are pre-heated through heat exchanging with the stripped tailings from the vessel lower section.

14. The method of claim 1, wherein the froth treatment tailings are introduced into the vessel via an inlet situated in the middle section of the vessel.

15. The method as claimed in claim 1, wherein the stripped tailings are removed from the lower section of the vessel for disposal.

16. The method of claim 1, wherein the steam bubbles further carry bitumen and fines to form a froth layer in the upper section of the vessel.

17. The method of claim 16, wherein the froth layer is removed for disposal.

18. The method as claimed in claim 16, further comprising removing the froth layer from the vessel and treating the removed froth layer to remove bitumen and residual hydrocarbon diluent therefrom.

19. The method of claim 18, wherein the treated froth layer is removed for disposal.

20. The method of claim 16, further comprising removing the froth layer from the vessel and reprocessing it in a froth treatment plant.

* * * * *